US009174827B2

(12) United States Patent
Takesue et al.

(10) Patent No.: US 9,174,827 B2
(45) Date of Patent: Nov. 3, 2015

(54) POWER ASSIST DEVICE, METHOD OF CONTROLLING POWER ASSIST DEVICE, AND PROGRAM OF POWER ASSIST DEVICE

(71) Applicants: Naoyuki Takesue, Hino (JP); Hideo Fujimoto, Nagoya (JP); Rikiya Makino, Toyota (JP); Kousyun Fujiwara, Okazaki (JP)

(72) Inventors: Naoyuki Takesue, Hino (JP); Hideo Fujimoto, Nagoya (JP); Rikiya Makino, Toyota (JP); Kousyun Fujiwara, Okazaki (JP)

(73) Assignees: NAGOYA INSTITUTE OF TECHNOLOGY, Nagoya-Shi (JP); TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 140 days.

(21) Appl. No.: 13/848,414

(22) Filed: Mar. 21, 2013

(65) Prior Publication Data

US 2013/0251496 A1 Sep. 26, 2013

(30) Foreign Application Priority Data

Mar. 22, 2012 (JP) ..... 2012-065696

(51) Int. Cl.
*B66D 1/48* (2006.01)
*B66D 1/26* (2006.01)
*B66D 3/18* (2006.01)

(52) U.S. Cl.
CPC .. *B66D 1/48* (2013.01); *B66D 1/26* (2013.01); *B66D 3/18* (2013.01)

(58) Field of Classification Search
USPC ..... 254/278, 283, 286, 290, 292, 293, 268, 254/272, 273, 274, 275
See application file for complete search history.

(56) References Cited

U.S. PATENT DOCUMENTS 3,043,444 A * 7/1962 Melton ..... 212/274
6,241,462 B1 * 6/2001 Wannasuphoprasit et al. ..... 414/800

FOREIGN PATENT DOCUMENTS

| | | | |
|---|---|---|---|
| JP | 02-152900 | A | 6/1990 |
| JP | 02-205489 | A | 8/1990 |
| JP | 05-310396 | A | 11/1993 |
| JP | 07-206379 | A | 8/1995 |
| JP | 08-208181 | A | 8/1996 |
| JP | 11-198077 | A | 7/1999 |
| JP | 2001-270687 | A | 10/2001 |
| JP | 2011-057335 | A | 3/2011 |

* cited by examiner

*Primary Examiner* — Emmanuel M Marcelo
*Assistant Examiner* — Angela Caligiuri
(74) *Attorney, Agent, or Firm* — Kenyon & Kenyon LLP

(57) ABSTRACT

A power assist device includes: holder holding a workpiece; a pair of wires each having one end connected to the holder to suspend the holder; a pair of wind-up wheels winding up respective other ends of the wires; a pair of motors rotationally driving the respective wind-up wheels; a pair of rotation detectors detecting rotation information of the respective motors; a pair of torque detectors detecting drive torque in the respective motors; and controller controlling drive of the motors. The controller calculates operating force to the workpiece based on the rotation information detected by the rotation detectors and the drive torque of the motors detected by the torque detectors, and controls the motors to assist the operating force that is calculated, to move up and down the holder.

7 Claims, 3 Drawing Sheets

POWER ASSIST DEVICE, METHOD OF CONTROLLING POWER ASSIST DEVICE, AND PROGRAM OF POWER ASSIST DEVICE

INCORPORATION BY REFERENCE

This application is based upon and claims the benefit of priority from Japanese patent application No. 2012-065696, filed on Mar. 22, 2012, the disclosure of which is incorporated herein in its entirety by reference.

BACKGROUND OF THE INVENTION

1. Field of the Invention

The present invention relates to a power assist device, a method of controlling the power assist device, and a program of the power assist device that are able to calculate operating force to a workpiece with high accuracy and to optimally perform power assist.

2. Description of Related Art

Various power assist devices are known that are able to suspend a workpiece by a wire to move the workpiece to a desired position according to manipulation by an operator. On the other hand, the operation method is to perform a button operation by an operation part to move the workpiece up and down or in a parallel direction, and its operability is not good.

On the other hand, such a power assist device is known to detect an average load applied to a wire by a force sensor as a reference load, calculates the operating force to the workpiece from the difference between the reference load and the current load from the force sensor, and drives a motor in an assist direction (see, for example, Japanese Unexamined Patent Application Publication No. 5-310396).

However, the power assist device disclosed in Japanese Unexamined Patent Application Publication No. 5-310396 stated above detects the load using a single force sensor. Accordingly, when there is a change in the reference load, for example, it may be difficult to calculate the operating force with high accuracy and power assist may not be optimally performed.

The present invention has been made in order to solve such problems, and mainly aims to provide a power assist device, a method of controlling the power assist device, and a program of the power assist device that are able to calculate operating force to a workpiece with high accuracy and to optimally perform power assist.

SUMMARY OF THE INVENTION

One exemplary aspect of the present invention to achieve the exemplary object stated above is a power assist device including: holding means that holds a workpiece; a pair of wires each having one end connected to the holding means to suspend the holding means; a pair of wind-up means that wind up respective other ends of the wires; a pair of driving means that rotationally drive the respective wind-up means; a pair of rotation detection means that detect rotation information of the respective driving means; a pair of torque detection means that detect drive torque in the respective driving means; and control means that controls drive of each of the driving means, in which the control means calculates operating force to the workpiece based on the rotation information detected by each of the rotation detection means and the drive torque of the driving means detected by each of the torque detection means, and controls each of the driving means to assist the operating force that is calculated, to move up and down the holding means.

In this exemplary aspect, the control means may calculate each of torque by the operating force to the workpiece and torque by a load of the workpiece and the holding means based on rotation angular velocity and rotation angular acceleration of the driving means detected by each of the rotation detection means and the drive torque of the driving means detected by each of the torque detection means, move up and down the workpiece by the torque by the operating force, and holds a position of the workpiece by the torque by the load.

In this exemplary aspect, the control means may calculate torque by tensile force applied to each of wires based on rotation angular velocity and rotation angular acceleration of the driving means detected by each of the rotation detection means and the drive torque of the driving means detected by each of the torque detection means, and calculate torque by the operating force to the workpiece and torque by a load of the workpiece and the holding means based on the torque by the tensile force applied to the wire using a kinetic model including inertia, viscosity, and friction.

In this exemplary embodiment, the control means may change a parameter of the impedance model between a case in which the workpiece is moved up and a case in which the workpiece is moved down.

On the other hand, one exemplary aspect of the present invention to achieve the exemplary object stated above may be a method of controlling a power assist device including: holding means that holds a workpiece; a pair of wires each having one end connected to the holding means to suspend the holding means; a pair of wind-up means that wind up respective other ends of the wires; and a pair of driving means that rotationally drive the respective wind-up means, the method including steps of: detecting rotation information of each of the driving means; detecting drive torque in each of the driving means; and calculating operating force to the workpiece based on the rotation information that is detected and the drive torque of the driving means that is detected, and controlling each of the driving means to assist the operating force that is calculated, to move up and down the holding means.

Further, one exemplary aspect of the present invention to achieve the exemplary object stated above may be a program of a power assist device including: holding means that holds a workpiece; a pair of wires each having one end connected to the holding means to suspend the holding means; a pair of wind-up means that wind up respective other ends of the wires; and a pair of driving means that rotationally drive the respective wind-up means, the program causing a computer to execute processing of calculating operating force to the workpiece based on rotation information of each of the driving means that is detected and drive torque in each of the driving means that is detected, and controlling each of the driving means to assist the operating force that is calculated, to move up and down the holding means.

According to the present invention, it is possible to provide a power assist device, a method of controlling the power assist device, and a program of the power assist device that are able to calculate operating force to a workpiece with high accuracy and to optimally perform power assist.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Figure 1:
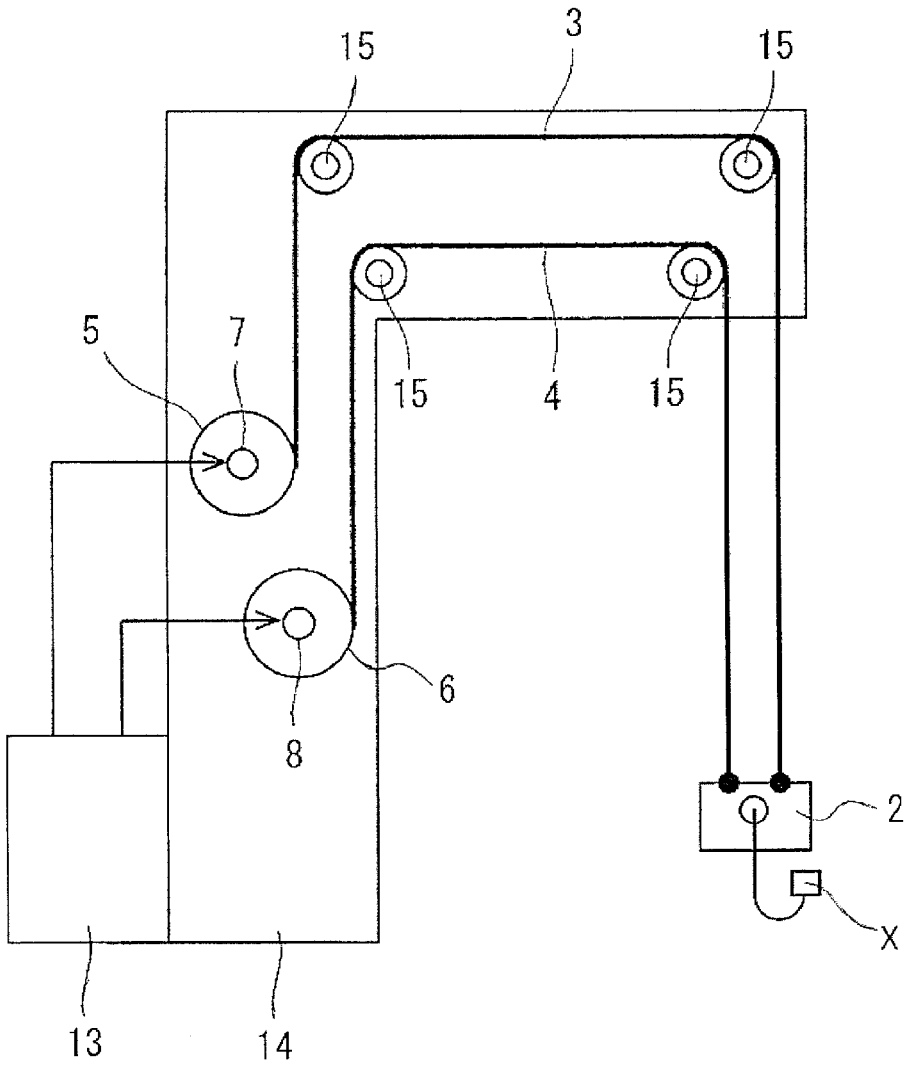
FIG. 1 is a diagram showing a schematic configuration of a power assist device according to one exemplary embodiment of the present invention.
Figure 2:
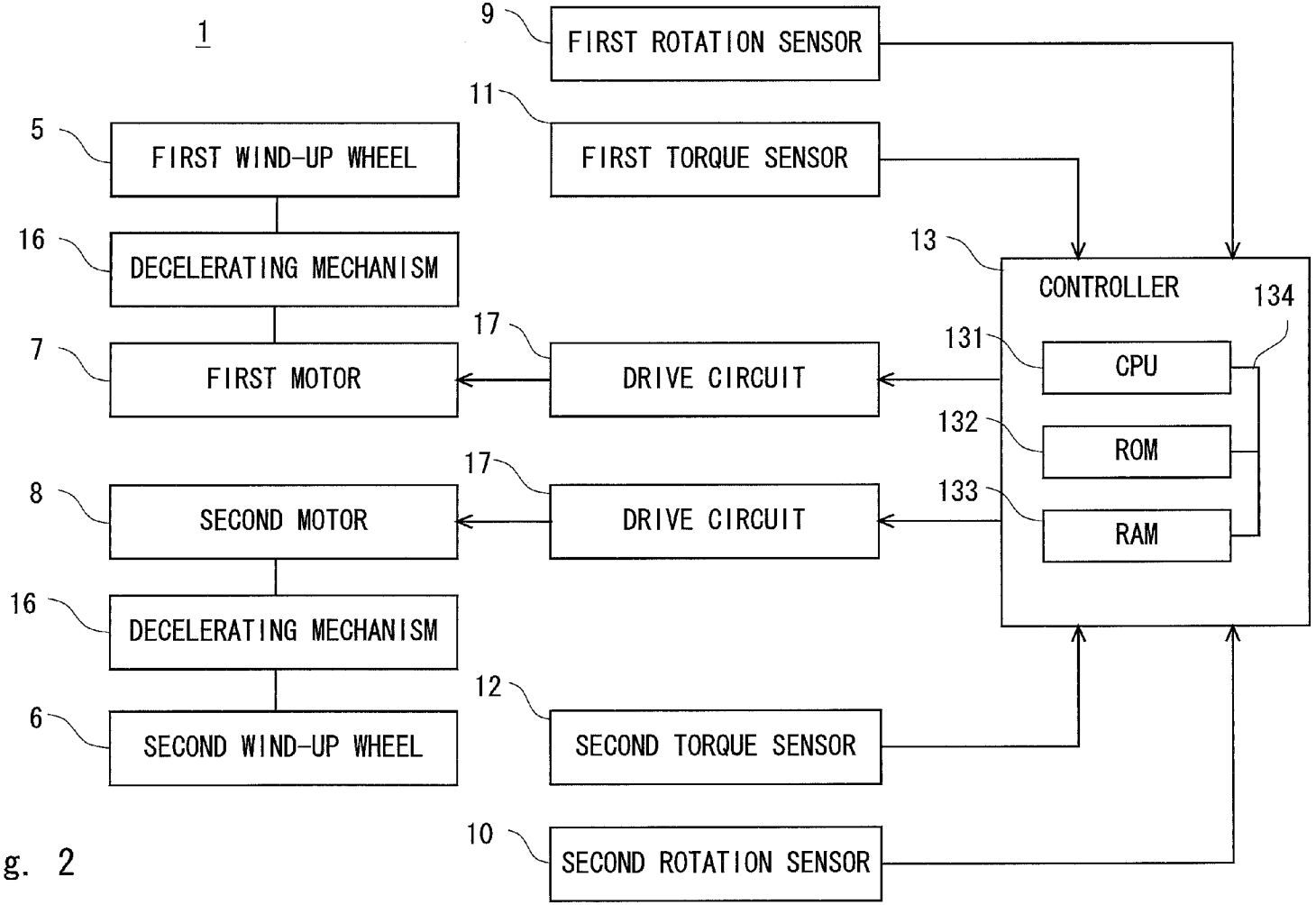
FIG. 2 is a block diagram showing a schematic system configuration of the power assist device according to the exemplary embodiment of the present invention.

Hereinafter, with reference to the drawings, an exemplary embodiment of the present invention will be described. FIG. 1 is a diagram showing a schematic configuration of a power assist device according to one exemplary embodiment of the present invention. Further, FIG. 2 is a block diagram showing a schematic system configuration of the power assist device according to the exemplary embodiment of the present invention.

When a user operates a workpiece X that is held in the vertical direction, a power assist device 1 according to this exemplary embodiment assists the operating force to move up and down the workpiece X. The power assist device 1 includes a hook part 2 that holds the workpiece X, a pair of first wire 3 and second wire 4 each having one end connected to the hook part 2 to suspend the hook part 2, a pair of first wind-up wheel 5 and second wind-up wheel 6 that wind up the other ends of the first wire 3 and the second wire 4, respectively, a pair of first motor 7 and second motor 8 that rotationally drive the first wind-up wheel 5 and the second wind-up wheel 6, respectively, a pair of first rotation sensor 9 and second rotation sensor 10 that detect rotation information of the first motor 7 and the second motor 8, respectively, a pair of first torque sensor 11 and second torque sensor 12 that detect drive torque in the first motor 7 and the second motor 8, respectively, and a controller 13 that controls drive of the first motor 7 and the second motor 8.

The hook part 2 is one specific example of holding means, and is configured, for example, to be able to hook and suspend the workpiece X. However, it is not limited to this. Any configuration may be employed as long as the hook part 2 is able to hold the workpiece X.

The first wire 3 and the second wire 4 are metallic wire ropes or chains, for example. One end of each of the first wire 3 and the second wire 4 is connected to the upper end of the hook part 2, and the other end of each of the first wire 3 and the second wire 4 is connected to the first wind-up wheel 5 and the second wind-up wheel 6, to raise or lower the hook part 2. While the pair of wires are each connected to the upper end of the hook part 2, such a configuration may be employed in which the pair of wires are connected in one line, a movable pulley is arranged in the upper end of the hook part 2, and the movable pulley is suspended by this wire.

The first wind-up wheel 5 and the second wind-up wheel 6 are one specific example of a pair of wind-up means, and are substantially cylindrical members rotatably coupled to a supporting member 14. The first wind-up wheel 5 and the second wind-up wheel 6 are connected to the other ends of the first wire 3 and the second wire 4, respectively, via two pulleys 15 rotatably coupled to the supporting member 14. Then, the first wind-up wheel 5 and the second wind-up wheel 6 are rotated to wind up or unwind the first wire 3 and the second wire 4. Thus, the workpiece X held in the hook part 2 is moved up and down. Note that the number and the position of the pulleys 15 provided between the first and second wind-up wheels 5 and 6 and the first and second wires 3 and 4 may be arbitrarily determined.

The first motor 7 and the second motor 8 are one specific example of a pair of driving means, and are coupled to the first wind-up wheel 5 and the second wind-up wheel 6 via decelerating mechanisms 16, for example. The first motor 7 and the second motor 8 are each connected to the controller 13 via a drive circuit 17. The first motor 7 and the second motor 8 rotate the first wind-up wheel 5 and the second wind-up wheel 6 in the clockwise direction or the counterclockwise direction (wind-up direction or unwind direction) according to control signals from the controller 13.

The first rotation sensor 9 and the second rotation sensor 10 are one specific example of a pair of rotation detection means, and are included in the first motor 7 and the second motor 8, for example. The first rotation sensor 9 and the second rotation sensor 10 may be formed of potentiometers, rotary encoders or the like, and detect rotation information such as rotation angles, rotation angular velocities, and rotation angular accelerations of the first motor 7 and the second motor 8. The first rotation sensor 9 and the second rotation sensor 10 are connected to the controller 13, and output the rotation information that is detected to the controller 13.

The first torque sensor 11 and the second torque sensor 12 are one specific example of a pair of torque detection means. The first torque sensor 11 and the second torque sensor 12 are attached to the first motor 7 and the second motor 8, and detect the drive torque occurred in the first motor 7 and the second motor 8, respectively. The first torque sensor 11 and the second torque sensor 12 are connected to the controller 13, and output the drive torque that is detected to the controller 13.

The controller 13 calculates the operating force to the workpiece X based on the rotation information from the first rotation sensor 9 and the second rotation sensor 10 and the drive torque from the first torque sensor 11 and the second torque sensor 12, generates control signals to the first motor 7 and the second motor 8 so as to assist the operating force that is calculated, and outputs the control signals that are generated to the first motor 7 and the second motor 8 via the drive circuits 17.

While the controller 13 calculates the operating force to the workpiece X using the drive torque from the first torque sensor 11 and the second torque sensor 12, it is not limited to this. For example, the controller 13 may calculate the operating force to the workpiece X using torque command values to the first motor 7 and the second motor 8 or current values to drive the first motor 7 and the second motor 8.

The controller 13 is configured in hardware and mainly includes a microcomputer that includes a CPU (Central Processing Unit) 131 performing control processing, operation processing and the like, a ROM (Read Only Memory) 132 storing an operation program, a control program executed by the CPU 131 and the like, and a RAM (Random Access Memory) 133 that temporarily stores processed data and the like. These CPU 131, the ROM 132, and the RAM 133 are connected to each other by a data bus 134 or the like.

By the way, conventional power assist devices perform a button operation and the like by an operation part, and its operability is not good. The power assist device 1 according to this exemplary embodiment calculates the operating force to the workpiece X based on the rotation information detected by the first rotation sensor 9 and the second rotation sensor 10 and the drive torque of the first motor 7 and the second motor 8 detected by the first torque sensor 11 and the second torque sensor 12, and controls the first motor 7 and the second motor 8 so as to assist the operating force that is calculated, to move up and down the hook part 2.

Accordingly, it is possible to calculate the operating force to the workpiece X by the user with high accuracy, and move up and down the workpiece X according to the operating force, to optimally perform power assist.

The controller 13 calculates each of torque τh by the operating force to the workpiece X and torque τw by the load of the workpiece X and the hook part 2 using the following expression (1) based on rotation information θ1 and θ2 from the first rotation sensor 9 and the second rotation sensor 10 and drive torque τ1 and τ2 from the first torque sensor 11 and the second torque sensor 12.

$$I_1\ddot{\theta}_1+D_1\dot{\theta}_1+F_1(\dot{\theta}_1)=\tau_1-\tau_w/2-\tau_h$$

$$I_2\ddot{\theta}_2+D_2\dot{\theta}_2+F_2(\dot{\theta}_2)=\tau_2-\tau_w/2 \quad (1)$$

In the expression (1) above, I1 and I2 are moments of inertia of the first motor 7 and the second motor 8, respectively, D1 and D2 denote viscosity of the first motor 7 and the second motor 8, respectively, F1 and F2 denote friction force of the first motor 7 and the second motor 8, respectively, θ1 and θ2 are rotation angles of the first motor 7 and the second motor 8 detected by the first rotation sensor 9 and the second rotation sensor 10, respectively, and τ1 and τ2 are drive torque detected by the first torque sensor 11 and the second torque sensor 12, respectively.

The controller 13 generates control signals according to the torque τh by the operating force to the workpiece X and the torque τw by the load of the workpiece X and the hook part 2 calculated as described above, and outputs the control signals that are generated to the first motor and the second motor via the drive circuits.

In this way, the force applied to the first wire 3 and the second wire 4 can be calculated while separating the operating force to the workpiece X from the load of the workpiece X and the hook part 2. Accordingly, for the load of the workpiece X and the hook part 2, it is possible to occur the torque to hold the position, and for the operating force of the workpiece X by the user, it is possible to occur the torque to move up and down the workpiece X according to the operating force. Accordingly, it is possible to calculate the operating force to the workpiece X by the user with high accuracy to optimally perform power assist.

Figure 3A:
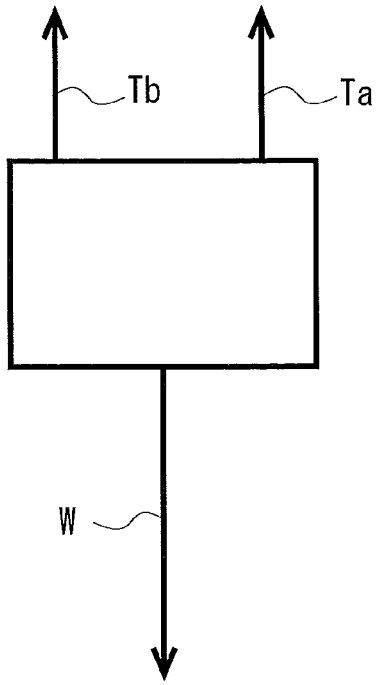
FIG. 3A is a diagram showing a state in which a workpiece is held by a first wire and a second wire.
Figure 3B:
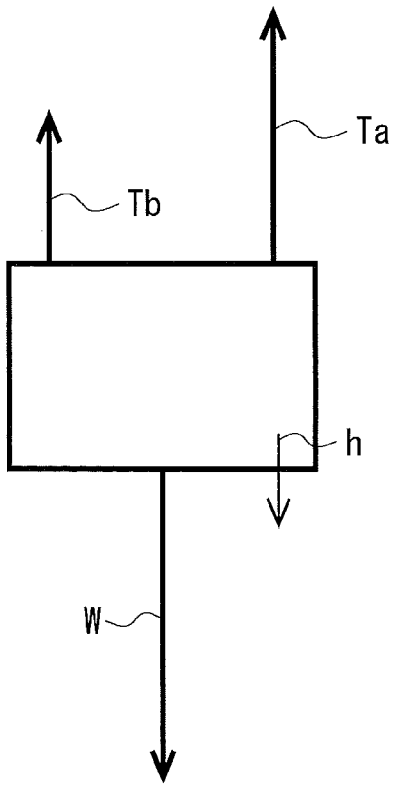
FIG. 3B is a diagram showing a state in which operating force is added to one side of the workpiece from a static state in which the workpiece is held by the first wire and the second wire.

Assume here a case in which tensile force Ta is applied to the first wire 3 and tensile force Tb is applied to the second wire 4 for the load w of the hook part 2 and the workpiece X and the static balance state is kept as shown in FIG. 3A. In this state, the load which is half the load w of the hook part 2 and the workpiece X is applied to each of the first wire 3 and the second wire 4. Further, as shown in FIG. 3B, when operating force h is applied from this state only to one side of the work X in the downward direction, the tensile force Ta to the first wire 3 of one side of the workpiece X increases so as to balance with the operating force h.

At this time, the controller 13 may calculate the operating force from the difference between the tensile force Ta applied to the first wire 3 and the tensile force Tb applied to the second wire 4, for example, and update the target rotation angles of the first motor 7 and the second motor 8 based on the following impedance model (2), to move up and down the workpiece X according to the operating force. Accordingly, for example, the user is able to easily move up and down the workpiece X which is heavy.

$$M_d\ddot{x}_d+D_d\ddot{x}_d=f_h \quad (2)$$

In the expression (2) stated above, Md denotes an inertia of the target impedance model, Dd denotes viscosity of the target impedance model, fh denotes operating force, and xd denotes a work target position. The target rotation angles of the first motor 7 and the second motor 8 are calculated from the work target position that is calculated, radii of the first wind-up wheel 5 and the second wind-up wheel 6, and the deceleration ratio of the first motor 7 to the second motor 8, and the controller 13 drives the first motor 7 and the second motor 8 via the drive circuits 17 to achieve the target rotation angles. In the above expression (2), virtual friction may further be added, and any desired model can be used. Further, each parameter may be changed as appropriate between the case in which the workpiece is moved up and the case in which the workpiece is moved down. In this way, it is possible to further improve the operability.

As described above, the power assist device 1 according to this exemplary embodiment calculates the operating force to the workpiece X based on the rotation information detected by the first rotation sensor 9 and the second rotation sensor 10 and the drive torque of the first motor 7 and the second motor 8 detected by the first torque sensor 11 and the second torque sensor 12, and controls the first motor 7 and the second motor 8 so as to assist the operating force that is calculated, to move up and down the hook part 2. Accordingly, it is possible to calculate the operating force to the workpiece X by the user with high accuracy, and move up and down the workpiece X according to the operating force, to optimally perform power assist. Further, the operating force to the workpiece X can be calculated without using a force sensor, which leads to cost reduction. Further, since it is possible to move up and down the workpiece X of various loads easily without performing any switch operation, its operability can be greatly improved.

While the present invention has been described as a hardware configuration in the exemplary embodiment stated above, the present invention is not limited to this. The present invention is able to achieve processing executed by the controller 13, for example, by causing the CPU 131 to execute a computer program.

The program can be stored and provided to a computer using any type of non-transitory computer readable media. Non-transitory computer readable media include any type of tangible storage media. Examples of non-transitory computer readable media include magnetic storage media (such as flexible disks, magnetic tapes, hard disk drives, etc.), optical magnetic storage media (e.g. magneto-optical disks), CD-ROM (Read Only Memory), CD-R, CD-R/W, and semiconductor memories (such as mask ROM, PROM (Programmable ROM), EPROM (Erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The present invention is applicable to a power assist device that moves up and down a heavy load or the like, for example.

REFERENCE SIGNS LIST

1 POWER ASSIST DEVICE
2 HOOK PART
3 FIRST WIRE
4 SECOND WIRE
5 FIRST WIND-UP WHEEL
6 SECOND WIND-UP WHEEL
7 FIRST MOTOR
8 SECOND MOTOR
9 FIRST ROTATION SENSOR
10 SECOND ROTATION SENSOR
11 FIRST TORQUE SENSOR
12 SECOND TORQUE SENSOR
13 CONTROLLER

What is claimed is:

1. A power assist device comprising:
a holding device that holds a workpiece;
a pair of wires each having one end connected to the holding device to suspend the holding device;
a pair of wind-up devices that wind up respective other ends of the wires;
a pair of driving devices that rotationally drive the respective wind-up devices;
a pair of rotation detection devices that detect rotation information of the respective driving devices;
a pair of torque detection devices that detect drive torque in the respective driving devices; and
a control device programmed to:
drive of each of the driving devices,
calculate each of torque by the operating force to the workpiece and torque by a load of the workpiece and the holding device based on rotation angular velocity and rotation angular acceleration of the driving devices detected by each of the rotation detection devices and the drive torque of the driving devices detected by each of the torque detection devices,
move up and down the workpiece by the torque by the operating force,
hold a position of the workpiece by the torque by the load,
calculate an operating force applied to the workpiece based on the rotation information detected by each of the rotation detection devices and the drive torque of the driving devices detected by each of the torque detection devices, and
control each of the driving devices to assist the calculated operating force, to move up and down the holding device.

2. The power assist device according to claim 1, wherein the control device is programmed to calculate each of the torque by the operating force to the workpiece and the torque by the load of the workpiece and the holding device using a kinetic model including inertia, viscosity, and friction.

3. The power assist device according to claim 1, wherein the control device is programmed to calculate a target rotation amount of each of the driving devices to assist the operating force based on the torque by the calculated operating force and an impedance model including inertia, viscosity, and friction.

4. The power assist device according to claim 3, wherein the control device is programmed to change a parameter of the impedance model between a case in which the workpiece is moved up and a case in which the workpiece is moved down.

5. A method of controlling a power assist device comprising:
a holding device that holds a workpiece;
a pair of wires each having one end connected to the holding device to suspend the holding device;
a pair of wind-up devices that wind up respective other ends of the wires; and
a pair of driving devices that rotationally drive the respective wind-up devices, the method comprising:
detecting rotation information of each of the driving devices;
detecting drive torque in each of the driving devices;
calculating each of torque by the operating force to the workpiece and torque by a load of the workpiece and the holding device based on rotation angular velocity and rotation angular acceleration of the driving devices and the drive torque of the driving devices,
moving up and down the workpiece by the torque by the operating force,
holding a position of the workpiece by the torque by the load,
calculating an operating force applied to the workpiece based on the detected rotation information and the detected drive torque of the driving devices; and
controlling each of the driving devices to assist the calculated operating force, to move up and down the holding device.

6. A program of a power assist device comprising:
a holding device that holds a workpiece;
a pair of wires each having one end connected to the holding device to suspend the holding device;
a pair of wind-up devices that wind up respective other ends of the wires; and
a pair of driving devices that rotationally drive the respective wind-up devices, the program causing a computer to execute processing of calculating each of torque by operating force to the workpiece and torque by a load of the workpiece and the holding device based on detected rotation angular velocity and rotation angular acceleration of the driving devices and the detected drive torque of the driving devices, moving up and down the workpiece by the torque by the operating force, holding a position of the workpiece by the torque by the load, calculating an operating force applied to the workpiece based on rotation information of each of the drive devices that is detected and drive torque in each of the driving devices that is detected, and controlling each of the driving devices to assist the calculated operating force to move up and down the holding device.

7. A power assist device comprising:
a holder that holds a workpiece;
a pair of wires each having one end connected to the holder to suspend the holder;
a pair of wind-up wheels that wind up respective other ends of the wires;
a pair of motors that rotationally drive the respective wind-up wheels;
a pair of rotation detectors that detect rotation information of the respective motors;
a pair of torque detectors that detect drive torque in the respective motors; and
a controller programmed to:
drive of each of the motors, calculate each of torque by the operating force to the workpiece and torque by a load of the workpiece and the holder based on rotation angular velocity and rotation angular acceleration of the motors detected by each of the rotation detectors and the drive torque of the motors detected by each of the torque detectors, move up and down the workpiece by the torque by the operating force, hold a position of the workpiece by the torque by the load, calculate an operating force applied to the workpiece based on the rotation information detected by each of the rotation detectors and the drive torque of the motors detected by each of the torque detectors, and control each of the motors to assist the calculated operating force, to move up and down the holder.

* * * * *